US006883844B2

(12) United States Patent
Carr

(10) Patent No.: US 6,883,844 B2
(45) Date of Patent: Apr. 26, 2005

(54) SPORTS BALL RETRIEVAL AND DISPENSING DEVICE WITH MULTI-PART RECEPTACLE AND HANDLE

(75) Inventor: Ronald H. Carr, Plum Boro, PA (US)

(73) Assignee: Ferrari Importing Company, Pittsburgh, PA (US)

( * ) Notice: Subject to any disclaimer, the term of this patent is extended or adjusted under 35 U.S.C. 154(b) by 329 days.

(21) Appl. No.: 09/815,397

(22) Filed: Mar. 22, 2001

(65) Prior Publication Data

US 2001/0048228 A1 Dec. 6, 2001

Related U.S. Application Data

(60) Provisional application No. 60/191,396, filed on Mar. 22, 2000.

(51) Int. Cl.[7] ..... A63B 47/02

(52) U.S. Cl. ..... 294/19.2; 414/440

(58) Field of Search ..... 294/19.2; 414/439, 414/440; 56/327.1, 328.1, 400.02; 473/460

(56) References Cited

U.S. PATENT DOCUMENTS

| | | | | |
|---|---|---|---|---|
| 3,227,298 A | * | 1/1966 | Shoemaker | 294/19.2 |
| 3,371,950 A | | 3/1968 | Stap | 294/15 |
| 3,485,398 A | | 12/1969 | Offner | 214/356 |
| 3,593,868 A | | 7/1971 | Fohz | 214/356 |
| 3,804,449 A | | 4/1974 | Falitz | 294/69 A |
| 3,902,749 A | | 9/1975 | Falitz | 294/19 A |
| 3,926,465 A | | 12/1975 | Hoagland et al. | 294/19 A |
| 4,193,625 A | * | 3/1980 | Nelson | 294/19.2 |
| 5,147,100 A | | 9/1992 | Frankel | 294/19.2 |
| 5,294,161 A | | 3/1994 | Stap | 294/19.2 |
| D347,670 S | | 6/1994 | Stap | D21/206 |
| 5,368,351 A | * | 11/1994 | Cuti | 248/132 |
| 5,407,242 A | | 4/1995 | Beranek | 294/19.2 |
| 5,464,262 A | * | 11/1995 | Madrazo | 294/19.2 |
| 5,507,541 A | * | 4/1996 | Chen et al. | 280/47.371 |
| 5,664,672 A | | 9/1997 | Niksich | 206/315.9 |

FOREIGN PATENT DOCUMENTS

| | | |
|---|---|---|
| DE | 3144898 | 11/1981 |
| FR | 2481128 | 10/1981 |
| GB | 1388 | 10/1902 |
| GB | 3628 | 11/1902 |
| GB | 469482 | 2/1937 |

* cited by examiner

*Primary Examiner*—Dean J. Kramer
(74) *Attorney, Agent, or Firm*—Michael R. Swartz

(57) ABSTRACT

A sports ball retrieval and dispensing device includes a ball retrieving and dispensing receptacle and a handle constructed of respective pluralities of separate parts having respective assembled conditions in which the receptacle parts are mounted to one another and the handle parts are mounted to one another and coupled to the assembled receptacle so as to enable use of the device in ball retrieving and dispensing modes of operation. The receptacle and/or handle also are convertible to respective disassembled conditions in which at least some receptacle parts are taken apart from one another and/or at least some handle parts are taken apart from one another such that the device occupies a reduced volume of space so as to enable packaging and shipping of the device.

45 Claims, 15 Drawing Sheets

SPORTS BALL RETRIEVAL AND DISPENSING DEVICE WITH MULTI-PART RECEPTACLE AND HANDLE

This utility patent application claims the benefit of provisional application No. 60/191,396 filed Mar. 22, 2000.

BACKGROUND OF THE INVENTION

1. Field of the Invention

The present invention generally relates to sports ball retrieval and dispensing devices and, more particularly, is concerned with a multi-part ball retrieving and dispensing receptacle and/or a multi-part handle convertible between assembled and disassembled conditions.

2. Description of the Prior Art

Sports ball pickup devices are typically used when practicing certain sports such as tennis, golf or baseball. During these practice sessions, numerous balls are used which can get scattered about on the practice courts or fields.

Devices such as those described in U.S. Pat. Nos. 3,804,449 and 3,902,749 to Falitz, U.S. Pat. No. 3,926,465 to Hoagland, U.S. Pat. No. 5,407,242 to Beranek, U.S. Pat. Nos. 3,371,950 and 5,294,161 to Stapp, U.S. Pat. No. 5,664,672 to Niksich, French Pat. No. 2,481,128 to Marin and U.K. Pat. No. 1388 to King have been developed in the past to facilitate retrieval and, in the case of some of these devices, also the dispensing of the balls. In most cases, the retrieval device is comprised of a basket or cage having a suitable handle and openings in the bottom of the cage through which the balls pass when the device is pressed down over the balls. Rolling devices, such as those proposed by Falitz, Hoagland, Beranek, Marin and King, provide an advantage of not needing to carry and lift the device in order to retrieve the balls.

In most cases, the baskets or cages are prefabricated by welding wires together. In the case of the King device, a cage is comprised of two discs or wheels rigidly connected to each other and bridged by wire, elastic, or strings between which the balls will pass and become captured into the receptacle. This makes the packaging for such devices bulky and costly to ship and store.

In the Stapp and Niksich patents, a ball retrieval device made up of several components which can be taken apart eliminates the problem associated with the bulkiness of the packaging. However, these devices require that the device be carried and lifted in order to retrieve the balls.

Consequently, a need still exists for an innovation in the construction of a ball retrieval and storage device that will provide a more effective and comprehensive solution to the aforecited problems of the prior art without introducing any new problems in place thereof.

SUMMARY OF THE INVENTION

The present invention provides a sports ball retrieval and dispensing device designed to satisfy the aforementioned need. The retrieval and dispensing device of the present invention includes a ball retrieving and dispensing receptacle and a handle constructed of respective pluralities of separate parts having respective assembled conditions in which the receptacle parts are mounted to one another and the handle parts are mounted to one another and coupled to the assembled receptacle so as to enable use of the device in ball retrieving and dispensing modes of operation. The receptacle and/or handle also are convertible to respective disassembled conditions in which at least some receptacle parts are taken apart from one another and/or at least some handle parts are taken apart from one another such that the device can occupy a substantially reduced volume of space so as to enable enhanced packaging and shipping of the device.

Accordingly, the present invention is directed to a sports ball retrieval and dispensing device which comprises: (a) a ball retrieving and dispensing receptacle constructed of a plurality of separate parts being convertible between an assembled condition in which the receptacle parts are mounted to one another so as to enable use of the device in carrying out ball retrieving and dispensing modes of operation and a disassembled condition in which at least some of the receptacle parts are taken apart from one another such that the device occupies a smaller volume of space with the receptacle in the disassembled condition than in the assembled condition so as to enable shipping of the device; and (b) a handle for coupling to the receptacle in the assembled condition so as to support the receptacle and thereby enable use of the device in carrying out the ball retrieving and dispensing modes of operation.

The present invention also is directed to a sports ball retrieval and dispensing device which comprises: (a) a ball retrieving and dispensing receptacle constructed as to enable use of the device in carrying out ball retrieving and dispensing modes of operation; and (b) a handle constructed of a plurality of separate parts being convertible between an assembled condition in which the handle parts are mounted to one another and coupled to the receptacle so as to support the receptacle and thereby enable use of the device in carrying out the ball retrieving and dispensing modes of operation and a disassembled condition in which at least some of the handle parts are taken apart from one another such that the device occupies a smaller volume of space with the handle in the disassembled condition than in the assembled condition so as to enable shipping of the device.

The present invention further is directed to a sports ball retrieving and dispensing device which comprises: (a) a ball retrieving and dispensing receptacle being constructed so as to enable use of the device in carrying out ball retrieving and dispensing modes of operation, the receptacle including (i) a pair of opposite end support members having respective peripheral portions, and (ii) a plurality of longitudinal elements having respective opposite ends and extending between and coupled to the opposite end support members, and (iii) means for holding the longitudinal elements together with the opposite end support members of the receptacle so as to form an enclosure structure defining a holding chamber for receiving and collecting a multiplicity of sports balls, the longitudinal elements being spaced apart from one another about the peripheral portions of the opposite end supports through distances less than a diameter of one of the sports ball to permit insertion of the sport balls between adjacent ones of the longitudinal elements for entry into the holding chamber; and (b) a handle coupled to the receptacle so as to rotatably support the receptacle on the handle and thereby enable use of the device in carrying out the ball retrieving and dispensing modes of operation, the handle including (i) an inner yoke member having opposite ends between which the receptacle is disposed, the receptacle having respective central portions defined on the opposite end support members of the receptacle which are aligned with and rotatably coupled to the opposite ends of the inner yoke member, and (ii) an outer handle member coupled to the inner yoke member for grasping by a user.

The present invention still further is directed to a ball retrieving receptacle which comprises: (a) an enclosure structure defining a holding chamber for receiving and collecting a multiplicity of sports balls; (b) at least a portion of the enclosure structure including a plurality of longitudinal elements being spaced apart from one another through distances less than a diameter of one of the sports ball so as to permit insertion of the sport balls between adjacent ones of the longitudinal elements for entry into the holding chamber; (c) the longitudinal elements being elongated rods made of a non-metallic, non-rubber material, such as fiber reinforced plastic.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
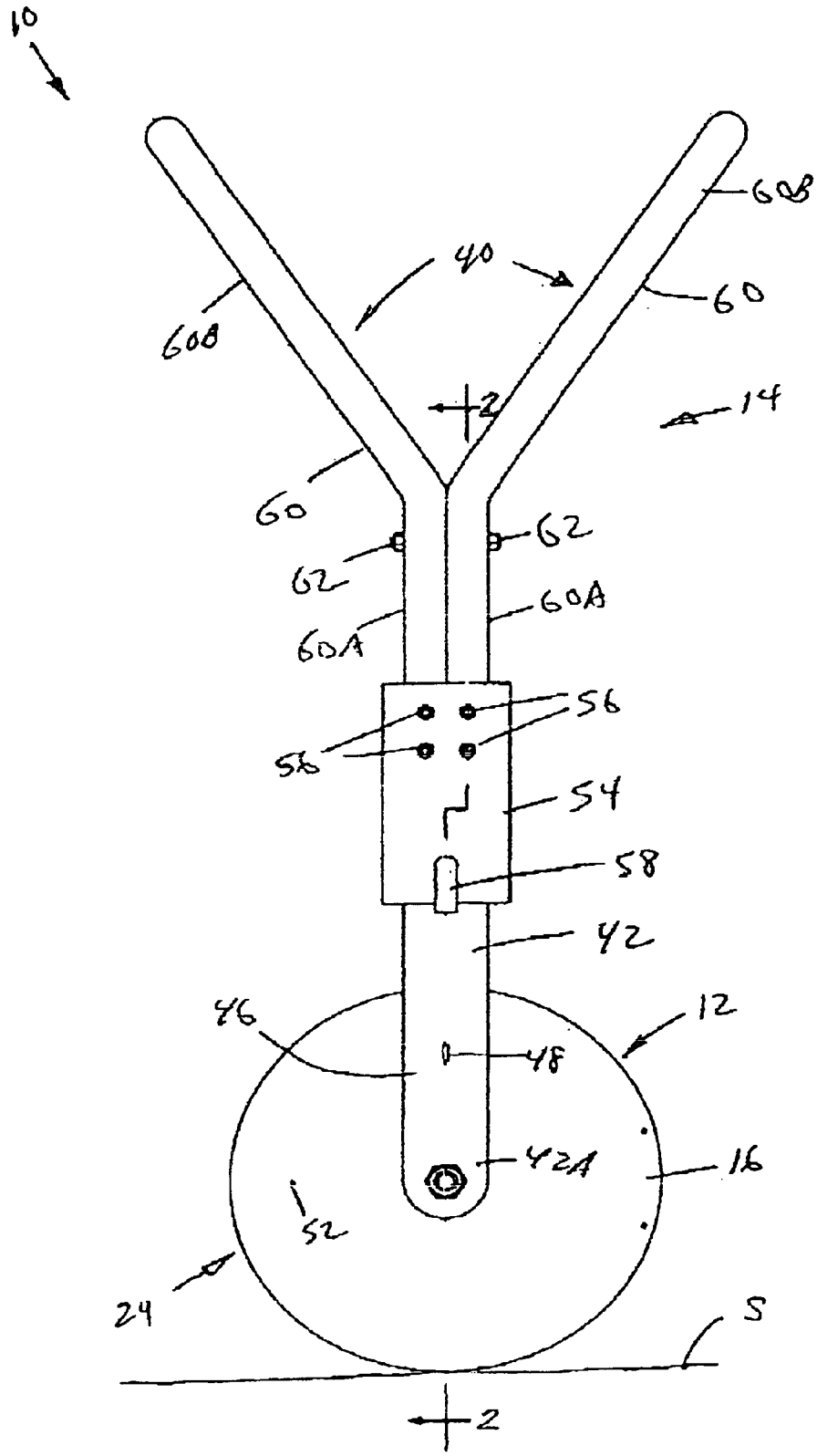
FIG. 1 is a side elevational view of a preferred embodiment of a sports ball retrieval and dispensing device of the present invention being shown in an orientation for carrying out a ball retrieving mode of operation.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Figure 2:
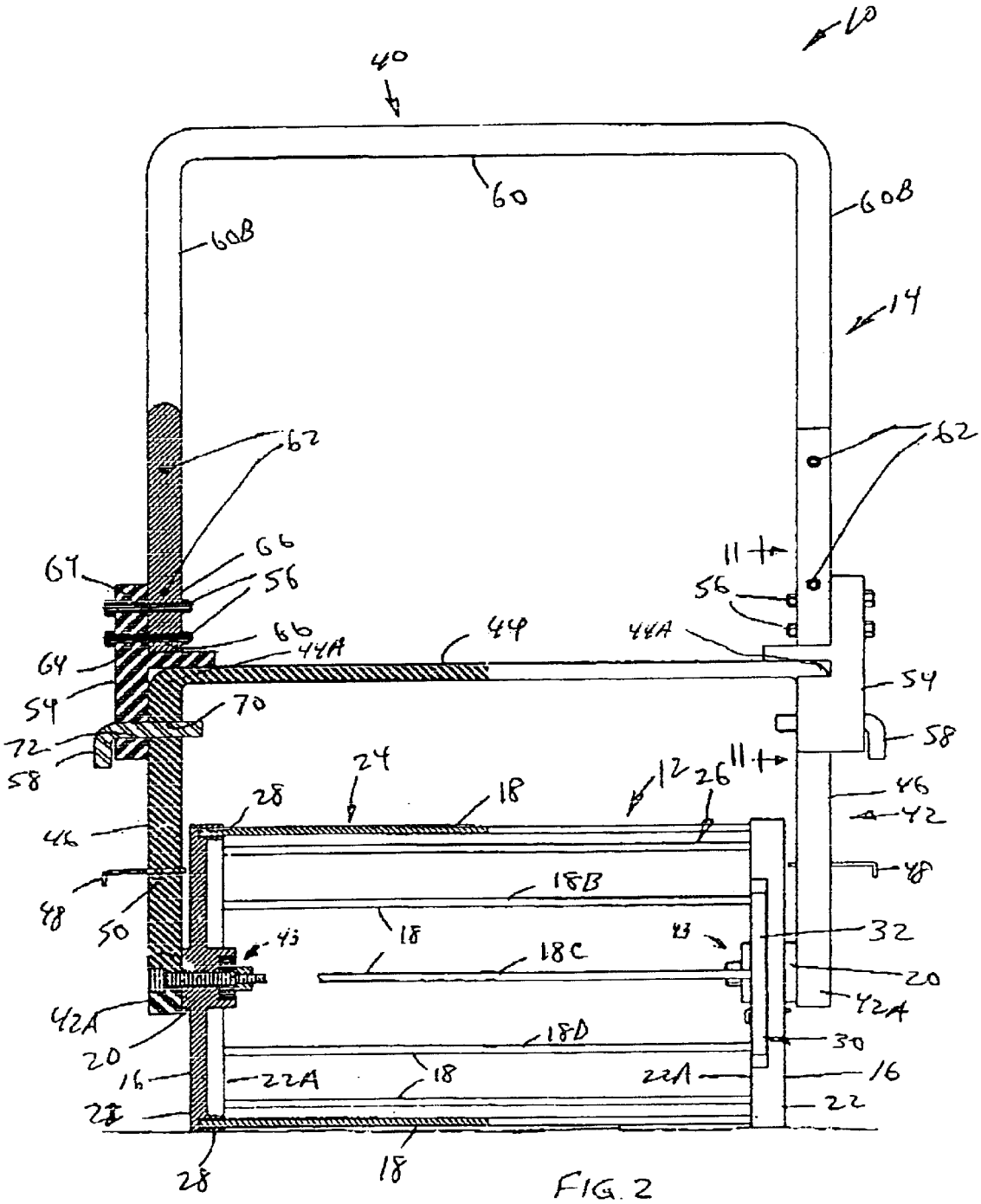
FIG. 2 is a partial longitudinal sectional view of the device taken along line 2—2 of FIG. 1.
Figure 3:
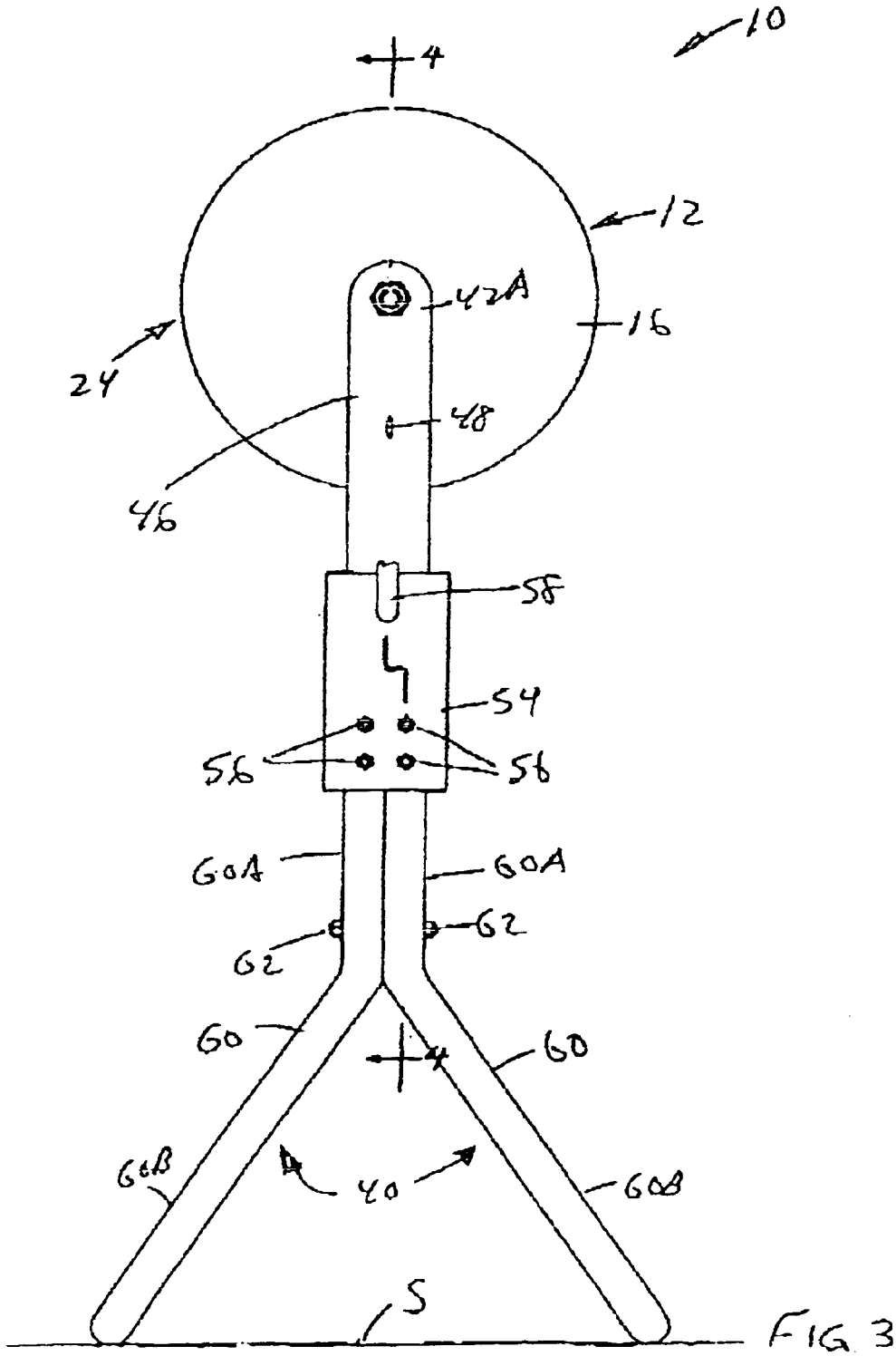
FIG. 3 is a side elevational view of the device of FIG. 1 now shown in an inverted orientation for carrying out a ball dispensing mode of operation.
Figure 4:
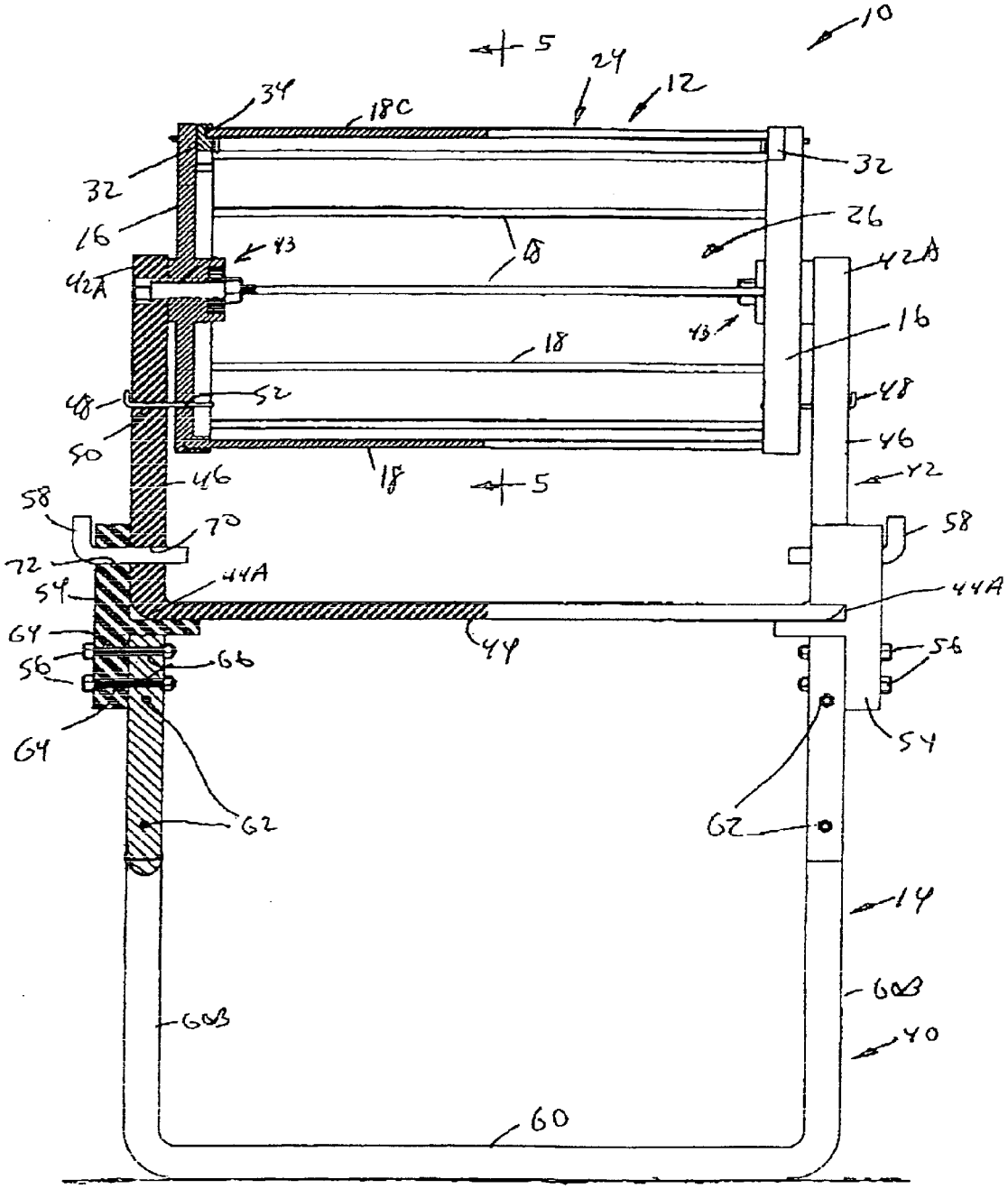
FIG. 4 is a partial longitudinal view of the device taken along line 4—4 of FIG. 3.

Referring to the drawings, and particularly to FIGS. 1 to 4, there is illustrated a preferred embodiment of a sports ball retrieval and dispensing device, generally designated 10, of the present invention. The device 10 basically includes a cylindrical ball retrieving and dispensing receptacle 12 and an elongated handle 14. The receptacle 12 is coupled to the handle 14 so as to rotatably support the receptacle 12 on the handle 14. The receptacle 12 and handle 14 of the device 10 are constructed as to enable use of the device 10 in carrying out ball retrieving and dispensing modes of operation. As seen in FIGS. 1 and 2, the handle 14 has a structural configuration which permits placement of the device 10 in a first orientation wherein the handle 14 positions the receptacle 12 below the handle 14 in movable contact with a surface S so that a user can grasp the handle 14 and move the receptacle 12 across the surface S in the ball retrieving mode of operation of the device 10. As seen in FIGS. 3 and 4, the structural configuration of the handle 14 also permits placement of the device 10 in a second orientation wherein the handle 14 can stand by itself stationarily on the surface S so as to position the receptacle 12 above the handle 14 so that a user can withdraw balls from the receptacle 12 in the ball dispensing mode of operation of the device 10. Also, the receptacle 12 and handle 14 are constructed of respective pluralities of separate parts having respective assembled conditions in which the receptacle parts are mounted to one another and the handle parts are mounted to one another and coupled to the assembled receptacle so as to enable use of the device 10 in either of the ball retrieving and dispensing modes of operation. The receptacle 12 and handle 14 also are convertible to respective disassembled conditions in which at least some parts of the receptacle 12 are taken apart and at least some parts of the handle 14 are taken apart such that the device 10 can now occupy a substantially reduced volume of space so as to enhance the packaging and shipping of the device 10.

Referring now to FIGS. 1 to 11 showing the preferred embodiment, the separate parts of the receptacle 12 of the device 10 include a pair of opposite end support members 16 and a plurality of longitudinal elements 18. Each of the opposite end support members 16 is preferably circular in shape and plate-like in configuration and has a central portion 20 and a peripheral portion 22 spaced radially outwardly from and surrounding the central portion 20. The longitudinal elements 18 preferably are in the form of elongated bars or rods 18 which extend between and are coupled at opposite ends 18A to the peripheral portions 22 of the opposite end support members 16 so as to form an enclosure structure 24 therewith that defines a holding chamber 26 for receiving and collecting a multiplicity of sports balls (not shown). The longitudinal elements or rods 18 are spaced apart from one another about the peripheral portions 22 of the opposite end support members 16 through distances less than a diameter of one of the sports ball to permit squeezing or insertion of the sport balls between adjacent ones of the longitudinal elements or rods 18 for entry of the balls into the holding chamber 26. More particularly, the elongated rods 18 are preferably made of a fiber reinforced plastic or of a fiber reinforced epoxy, although any other suitable materials, such as metal, can be used.

As best seen in FIGS. 2, 4, 6 and 7, the longitudinal elements or rods 18 are captured at the opposite ends 18A thereof in recesses 28 defined in inner sides 22A of the peripheral portions 22 of the opposite end support members 16 that face toward one another. Alternatively, the longitudinal elements 18 can be fastened at the opposite ends 18A thereof to the peripheral portions 22 of the opposite end support members 16.

Figure 5:
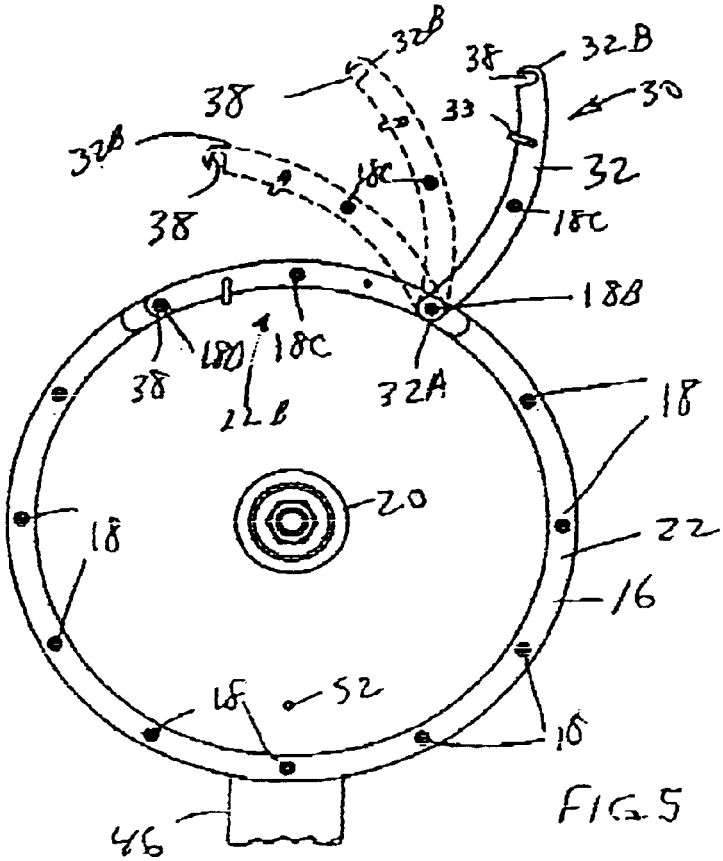
FIG. 5 is a transverse sectional view of a receptacle of the device taken along line 5—5 of FIG. 4.
Figure 6:
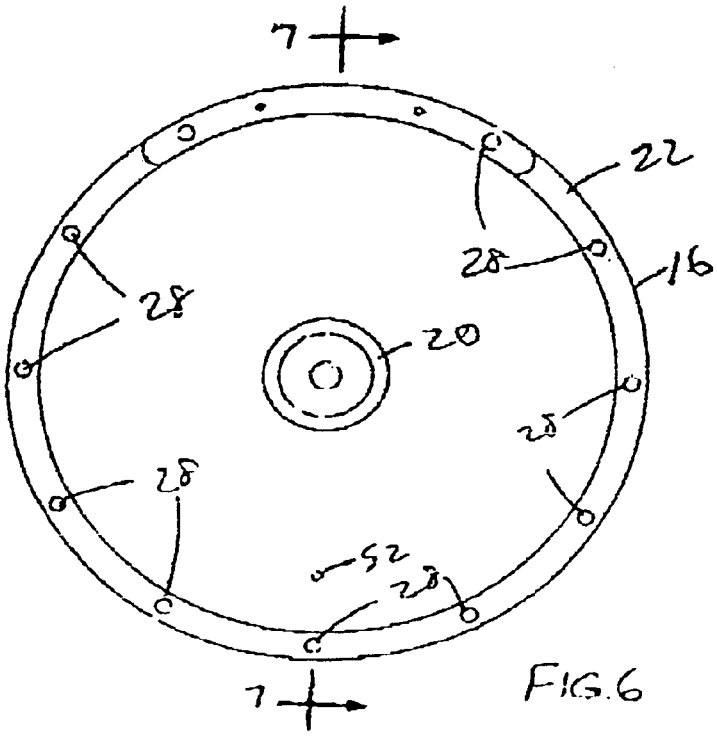
FIG. 6 is an end elevational view of a right one of a pair of opposite end support members of the receptacle as seen in FIG. 5.
Figure 7:
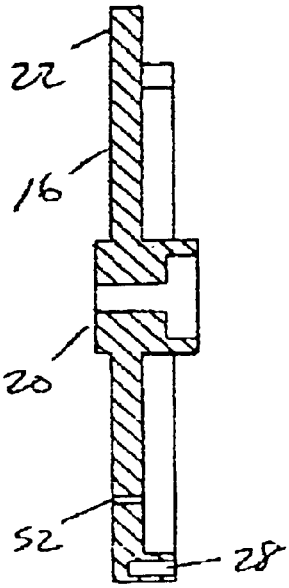
FIG. 7 is a cross-sectional view of the right end support member of the receptacle taken along line 7—7 of FIG. 6.
Figure 9:
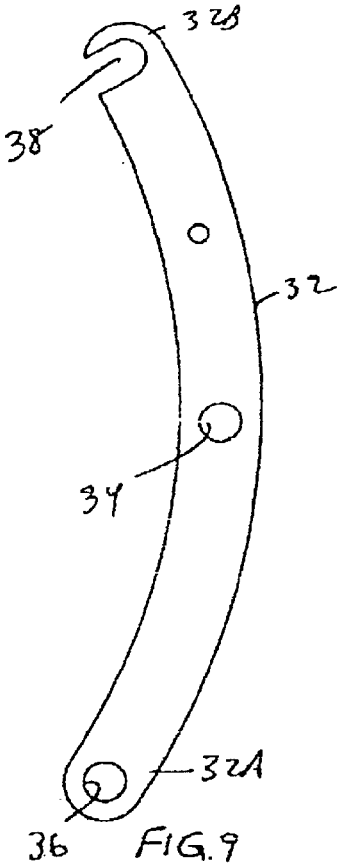
FIG. 9 is an inner side elevational view of the right end element of the gate structure as seen along line 9—9 of FIG. 8.
Figure 8:
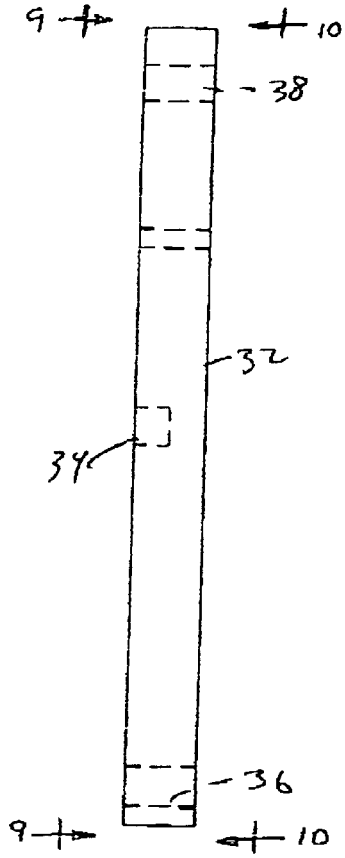
FIG. 8 is an top plan view of a right one of a pair of arcuate-shaped end elements of a gate structure pivotally mounted on the receptacle as seen in FIG. 5.
Figure 10:
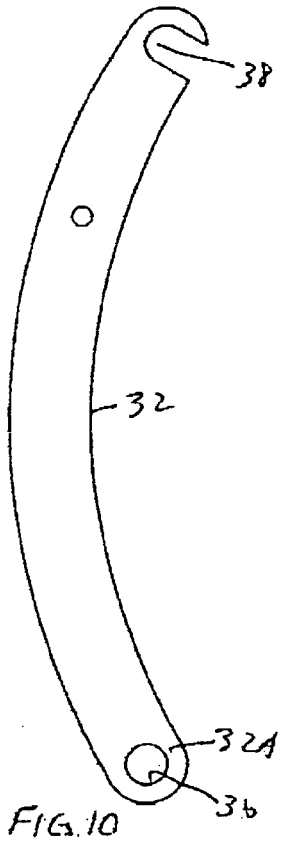
FIG. 10 is an outer side elevational view of the right end element of the gate structure as seen along line 10—10 of FIG. 8.
Figure 11:
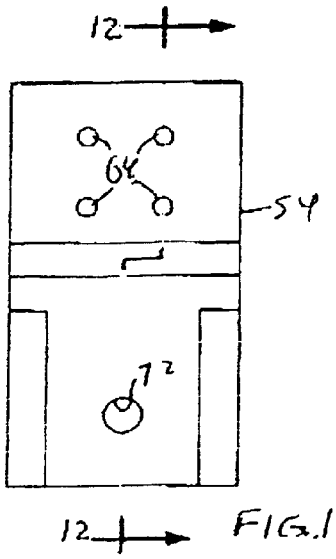
FIG. 11 is an inner end elevational view of a right one of a pair of connectors on the handle of the device as seen along line 11—11 of FIG. 2.
Figure 12:
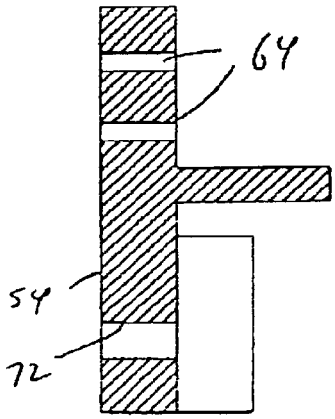
FIG. 12 is a longitudinal sectional view of the connector taken along line 12—12 of FIG. 11.

As best seen in FIGS. 4, 5 and 8 to 10, the separate parts of the receptacle 12 further include a gate structure 30 which is pivotally mounted to and extends between the opposite end support members 16 of the receptacle 12 along segments 22B of the peripheral portions 22 thereof. Each of the segments 22B has an arcuate length extending about one-sixth of the total circumference of the circular end support member 16. The gate structure 30 includes a pair of arcuate-shaped end elements 32 each pivotally mounted via one 18B of the longitudinal rods 18 adjacent to the segment 22B of the peripheral portion 22 of one of the opposite end support members 16 for undergoing pivotal movement, relative to the opposite end support members 16, between opened and closed positions as seen in FIG. 5. The gate structure 30 also includes another one 18C of the longitudinal elements or rods 18 of the receptacle. The another one rod 18C extends between and at the opposite ends 18A into recesses 34 defined in the arcuate-shaped end elements 32 about midway between the opposite ends 32A, 32B thereof. The end elements 32 at the one opposite ends 32A thereof have holes 36 defined therethrough which receive the one rod 18B therethrough. The other opposite ends 32B of the end elements 32 have slots 38 formed therein by which the ends 32B hook onto still another one rod 18D of the longitudinal elements or rods 18 of the receptacle 12 when the gate structure 30 is in its closed position. A snap pin 33 locks the gate structure 30 in its closed position.

Referring now to FIGS. 1 to 4, 11 and 12, the elongated handle 14 of the device 10 includes an outer handle member 40 and an inner yoke member 42 detachably connected to the outer handle member 40 and rotatably mounting the opposite end support members 16 of the receptacle 12 to opposite ends 42A of the inner yoke member 42 in bearing assembly 43. Thus, the receptacle 12 is disposed between and rotatably mounted to the opposite ends 42A of the inner yoke member 42.

More particularly, the inner yoke member 42 is generally U-shaped in configuration and includes a top portion 44 and a pair of opposite side portions 46. The top portion 44 has opposite ends 44A spaced apart at a distance greater than a distance between the opposite end support members 16 of the receptacle 12. The top portion 44 also extends in a generally parallel relationship to the longitudinal elements 18 of the receptacle 12 and in a generally transverse relationship to the opposite end support members 16 of the receptacle 12. Each of the opposite side portions 46 of the inner yoke member 42 is fixedly and preferably integrally attached to one of the opposite ends 44A of the top portion 44 and extends therefrom toward the receptacle 12. The opposite side portions 46 of the inner yoke member 42 also extends in a generally transverse relationship to the top portion 44 thereof and to the longitudinal elements or rods 18 of the receptacle 12 and in a generally parallel relationship to the opposite end support members 16 and along outer sides of the opposite end support members 16 that face in opposite directions away from one another. The opposite side portions 46 have ends thereon which correspond to the opposite ends 42A of the inner yoke member 42, being disposed adjacent and rotatably coupled to respective central portions 20 of the opposite end supports 16 of the receptacle 12.

As seen in FIGS. 2 and 4, the separate parts of the handle 14 further includes means 48 to prevent rotation of the receptacle 12 relative to the handle 14 during the ball dispensing mode of operation of device 10. One illustration of means 48 at least one and preferably a pair of pins 48. Each of the pins 48 are insertable through and removable from a pair of aligned apertures 50, 52 defined in each of the opposite side portions 46 of the inner yoke member 42 and each of the opposite end support members 16 of the receptacle 12. When each pin 48 is inserted through one of the pairs of aligned apertures 50, 52, the receptacle 12 is locked by the pin 48 against undergoing rotation relative to the handle 14 when the device 10 is in the ball dispensing mode of operation, as seen in FIGS. 3 and 4.

As seen in FIGS. 1 to 4, 10 and 11, the separate parts of the handle 14 still further include a pair of connectors 54, a plurality of fasteners 56 and a pair of latches 58. Also, the upper handle member 40 has a pair of U-shaped handle components 60 which are mirror images of one another and attached by fasteners 62 in a back-to-back arrangement wherein lower end portions 60A of the handle components 60 contact one another in a side-by-side relationship and upper portions 60B of the handle components 60 diverge from one another. The connectors 54 are respectively attached to the pairs of lower end portions 60A of the handle components 60 by the fasteners 56 which are inserted through aligned apertures 64, 66 defined in adjacent portions of the connectors 54 and the lower end portions 60A of the handle components 60.

The separate parts of the handle 14 further includes the pair of latches 58 insertable through and removable from aligned apertures 70, 72 defined in adjacent portions of the inner yoke member 42 and the connectors 54 of the outer handle member 40 for connecting the outer handle member 40 to and disconnecting the outer handle member 40 from the inner yoke member 42 so as to thereby convert the handle 14 between its assembled and disassembled conditions. The outer handle member 40 of the handle 14 is the part thereof that has the structural configuration permitting placement of the device 10 in the first orientation wherein the device 10 can be used in the ball retrieving mode of operation or in the inverted second orientation wherein the handle 14 can function as a stand positioned stationarily on the surface S with the receptacle 12 disposed thereabove for use in the ball dispensing mode of operation where the balls can be removed from the holding chamber 26 of the enclosure structure 24 by opening the gate structure 30 on the receptacle 12.

Referring now to FIGS. 13 to 34, there is shown first, second and third alternative embodiments of the receptacle 12 which mainly differ from the preferred embodiment of FIGS. 1 to 12 by the different configurations of the opposite end support members 16 and longitudinal elements 18 employed by the receptacle 12.

Figure 15:
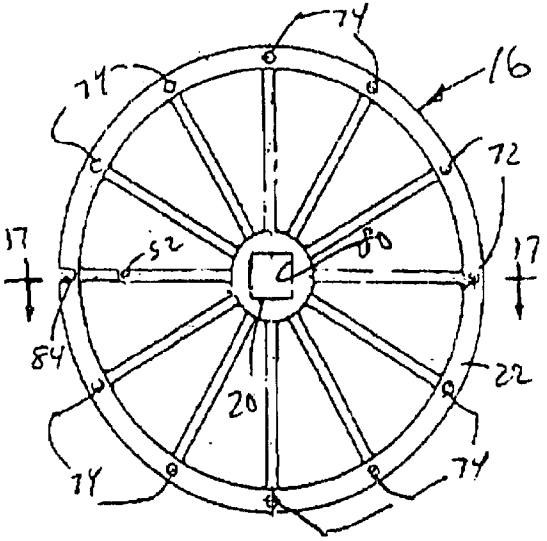
FIGS. 13 to 19 are various views of a first alternative embodiment of the receptacle.
Figure 17:
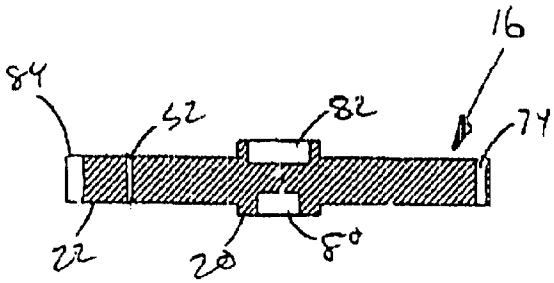
Figure 14:
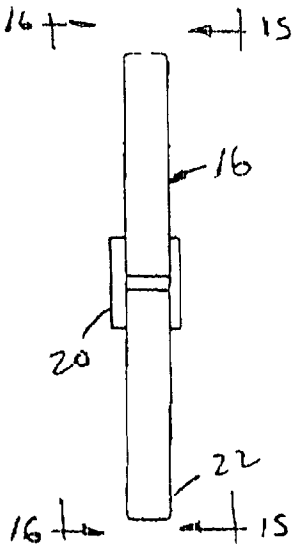
Figure 16:
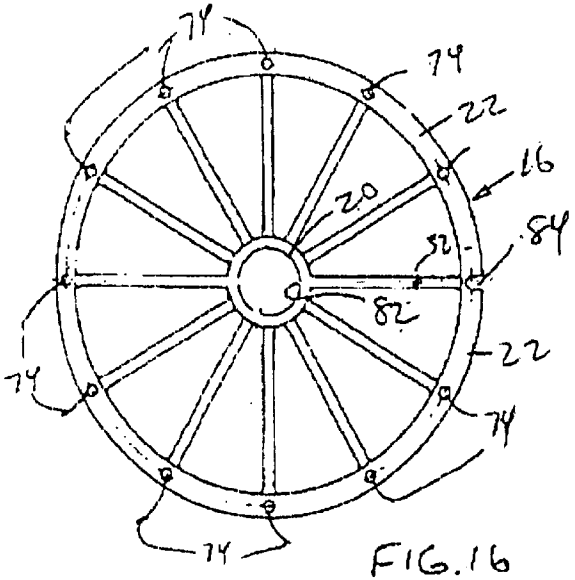
Figure 13:
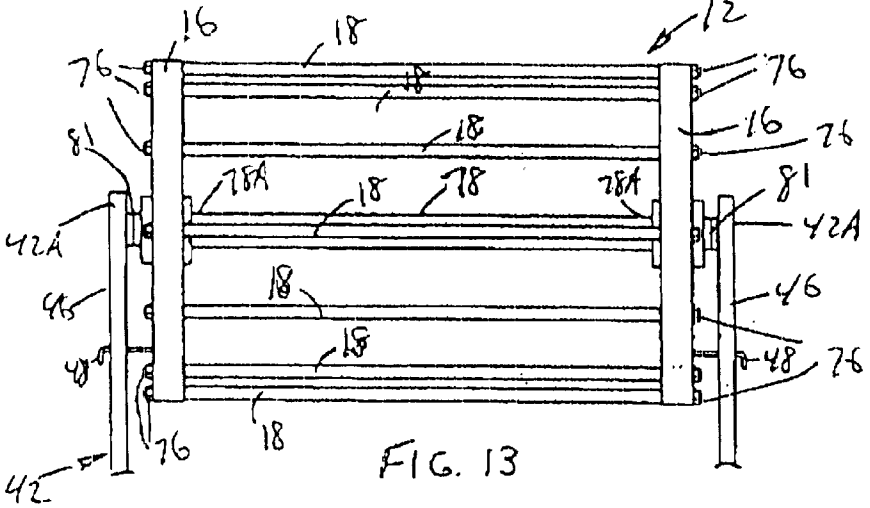
Figure 18:
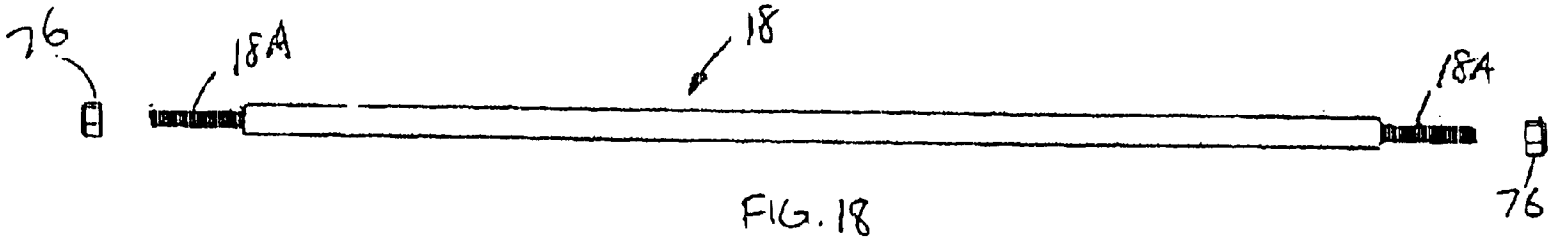
Figure 19:
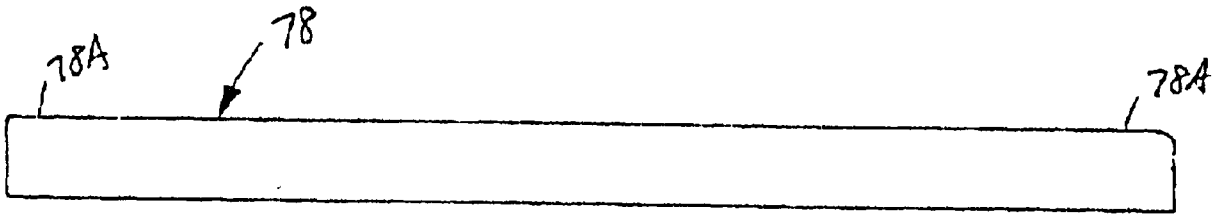
Figure 22:
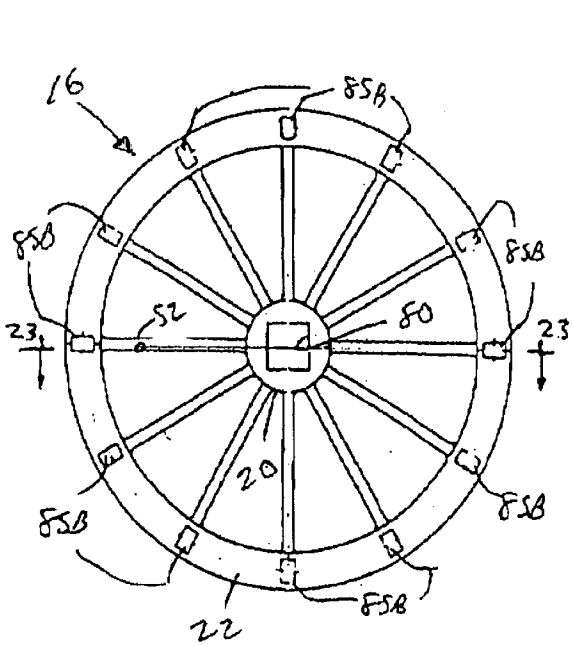
FIGS. 20 to 26 are various views of a second alternative embodiment of the receptacle.
Figure 20:
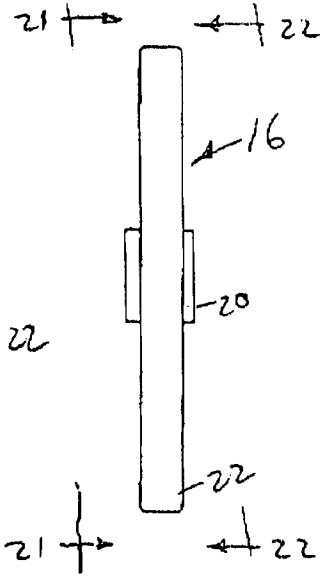
Figure 21:
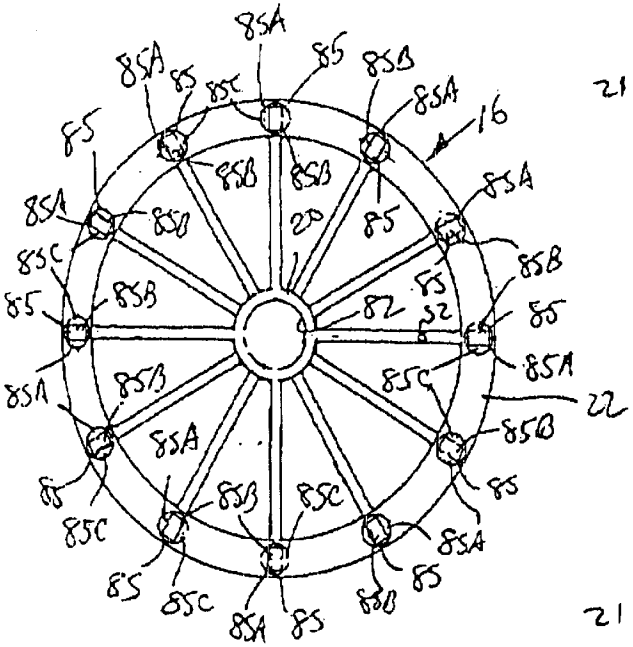
Figure 23:
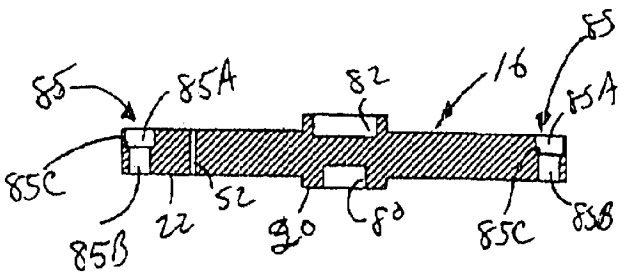
Figure 24:
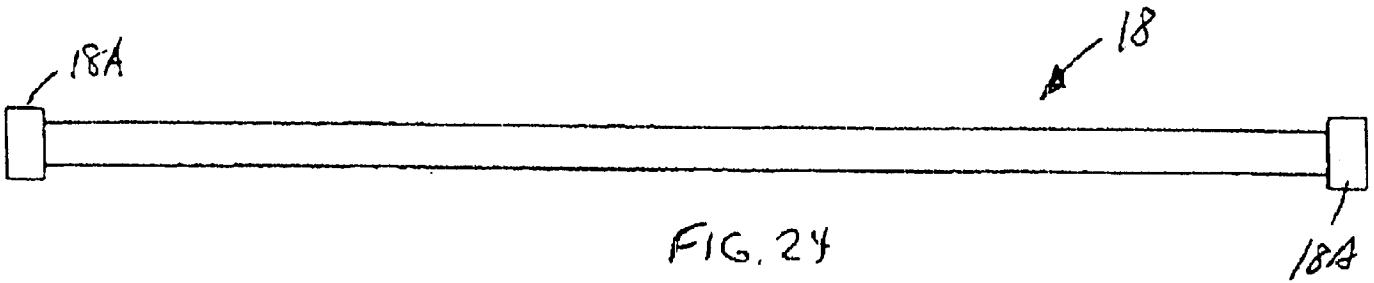

In FIGS. 13 to 19, there is shown the first alternative embodiment of the receptacle 12 which includes the pair of opposite end support members 16, in the form of molded disks or wheels made of metal or plastic, and a plurality of the longitudinal elements 18 having threaded opposite ends 18A. As best seen in FIG. 18, the threaded opposite ends 18A of the longitudinal elements or rods 18 are inserted through corresponding respective holes 74 formed through and spaced circumferentially from one another about the peripheral portions 22 of the opposite end support members 16, as seen in FIGS. 15 to 17, so as to displace the longitudinal elements 18 from one another through distances less than the diameter of a ball. Fastener nuts 76 are threaded over the threaded opposite ends 18A of the rods 18 so as to secure the rods 18 to the opposite end support members 16. As best seen in FIGS. 13 and 19, an elongated central brace member 78 having a rectangular cross-sectional shape is positioned to extend between the opposite end support members 16 such that the opposite ends 78A of the central brace member 78 are received and non-rotatably fitted into complementarily-shaped recesses 80 in the inner sides of the central portions 20 of the opposite end support members 16 as seen in FIGS. 15 and 17. The presence of the central brace member 78 between the opposite end support members 16 allows the fastener nuts 76 to be tightened down against the outer sides of the peripheral portions 22 of the opposite end support members 16 to secure the rods 18 thereto. As seen in FIGS. 13, cylindrical axles 81 are disposed between the opposite ends 42A of the inner yoke member 42 and circular recesses 82 formed in the outer sides of the central portions 20 of the opposite end support members 16, as seen in FIGS. 16 and 17, so as to freely rotatably mount the receptacle 12 by the inner yoke member 42 of the handle 14. The opposite ends 18A of one longitudinal rod 18C are fitted into respective slots 84 formed in the peripheral portions 22 of the opposite end support members 16 so as to facilitate easy removal of the rod 18C and thereby provide a gate on the receptacle 18.

Figure 26:
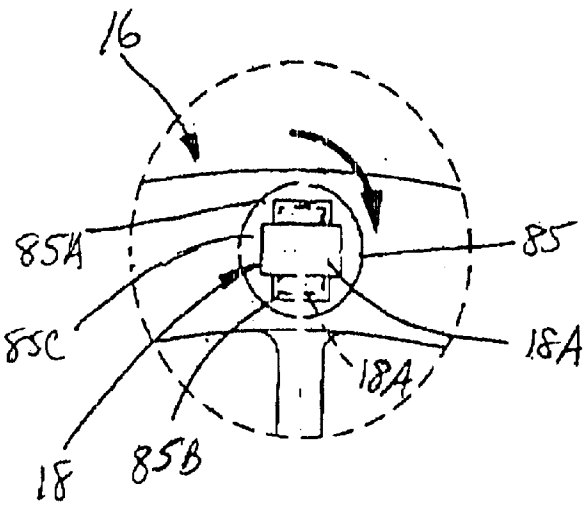
Figure 25:
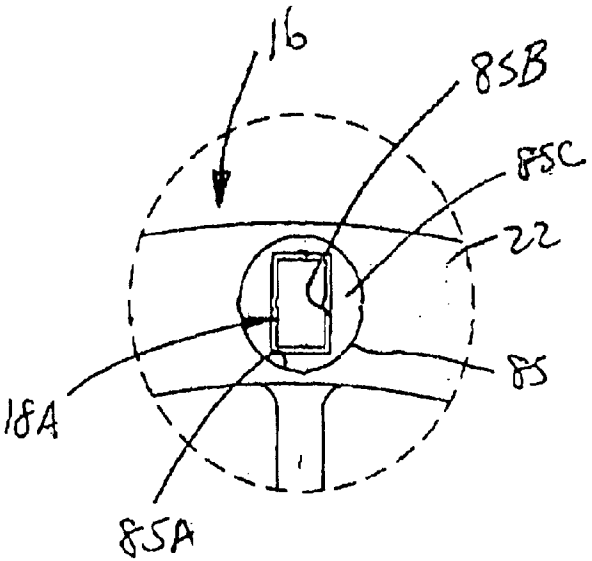
Figure 29:
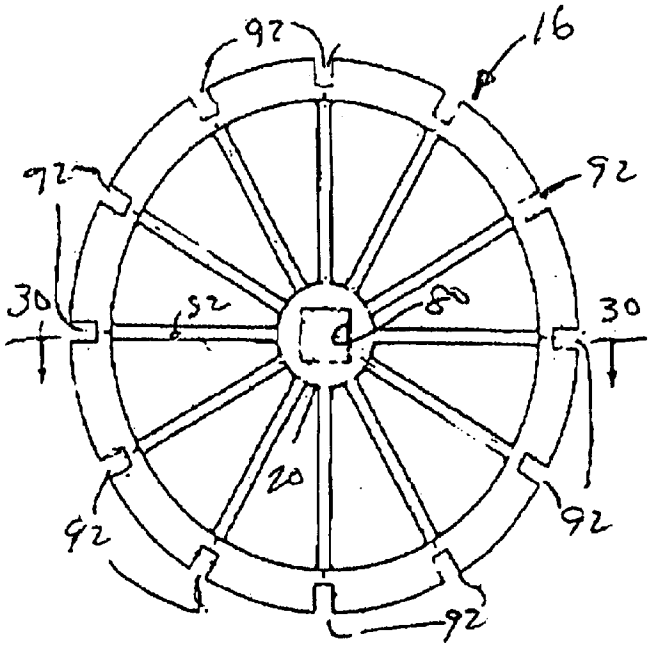
FIGS. 27 to 34 are various views of a third alternative embodiment of the receptacle.
Figure 30:
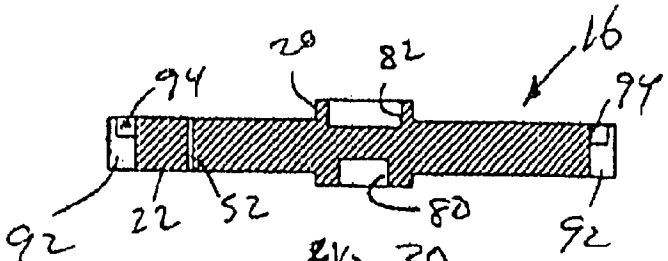
Figure 27:
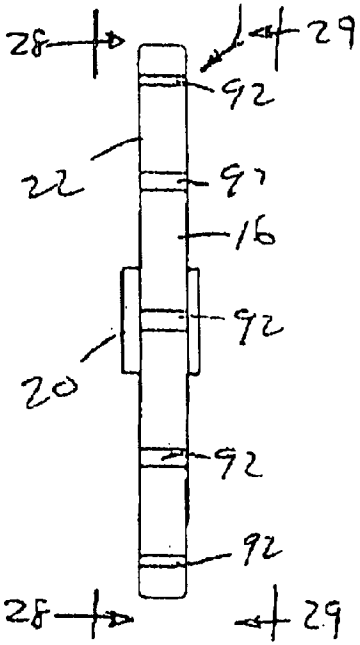
Figure 28:
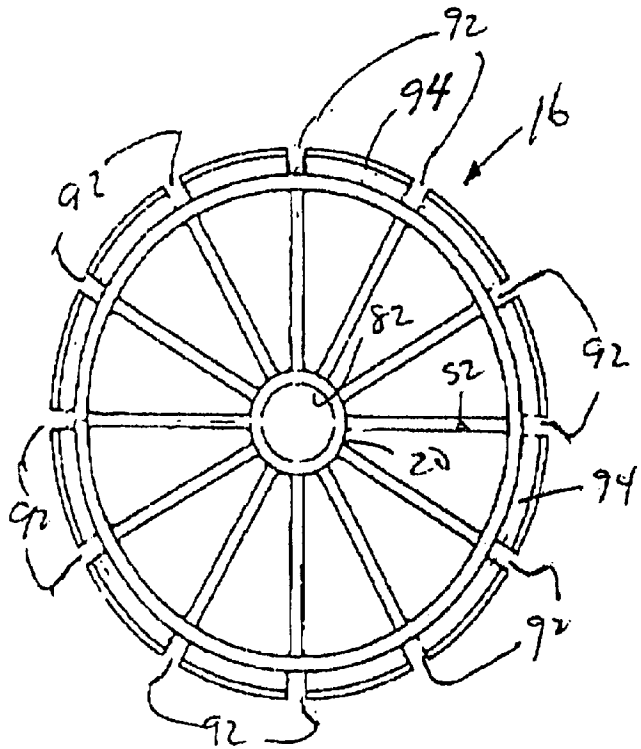
Figure 31:
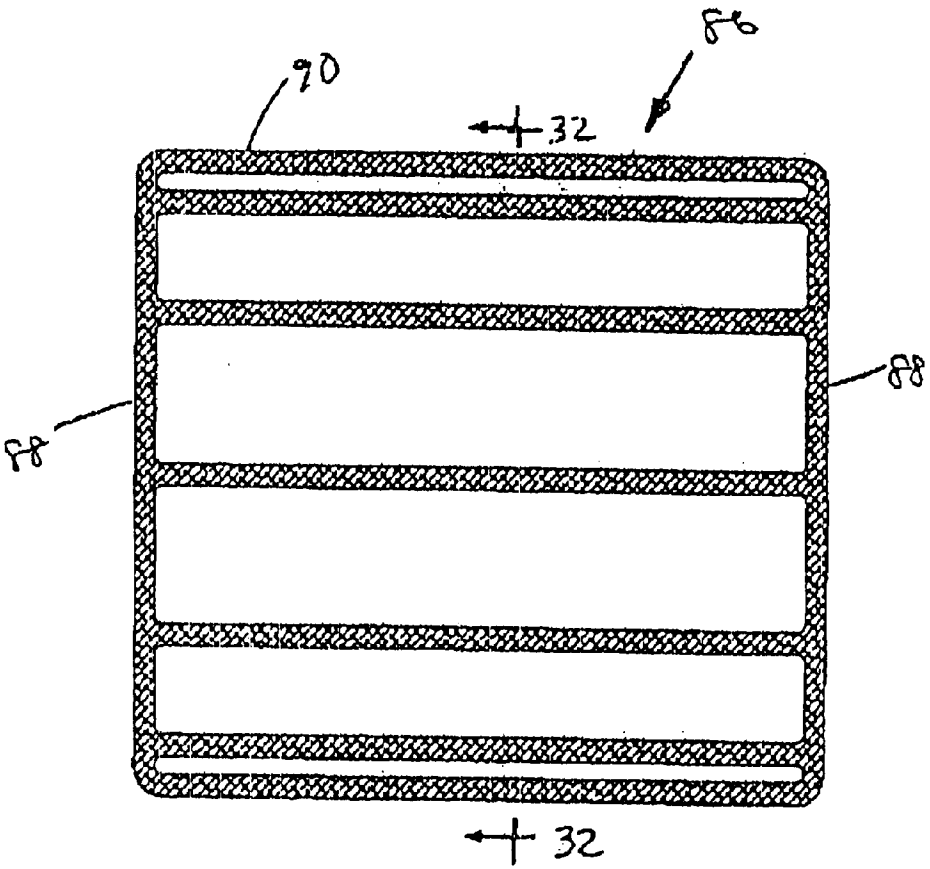
Figure 32:
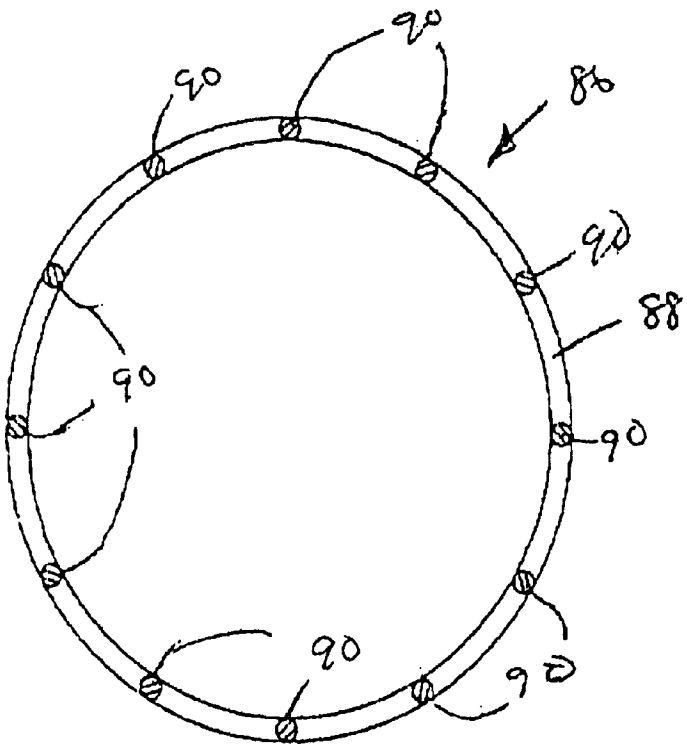
Figure 34:
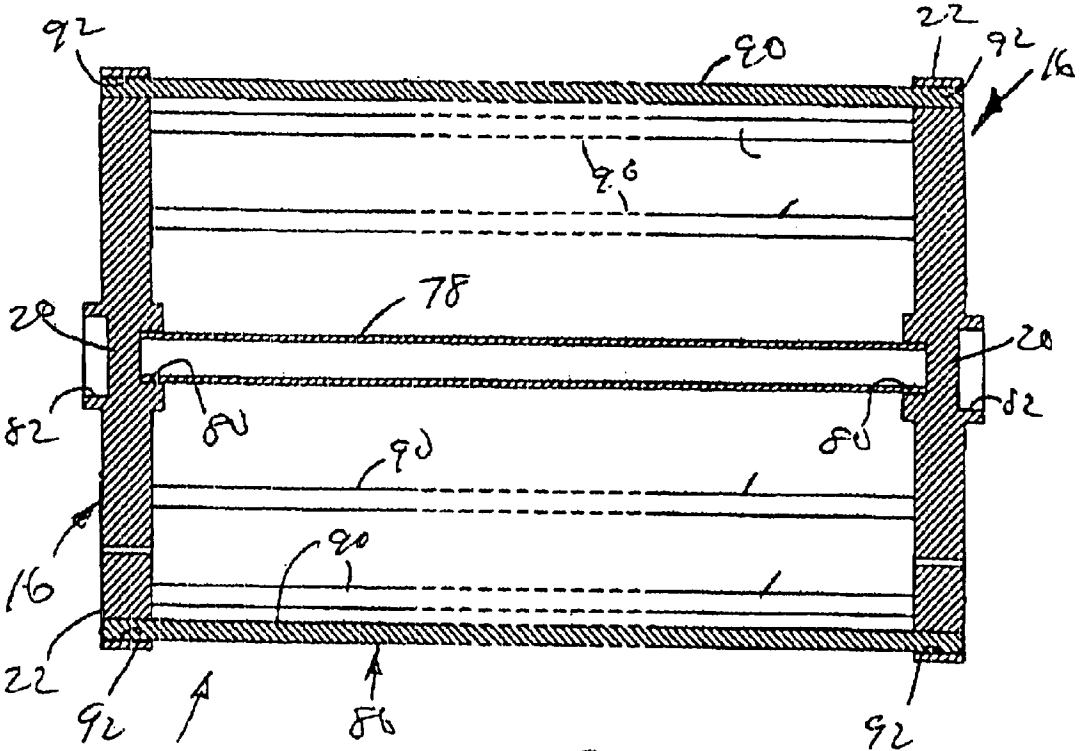
Figure 33:
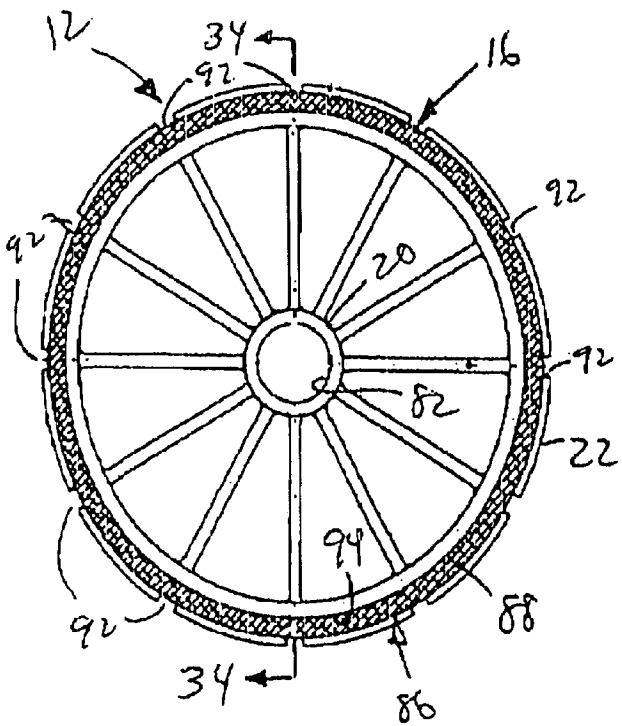
Figure 35:
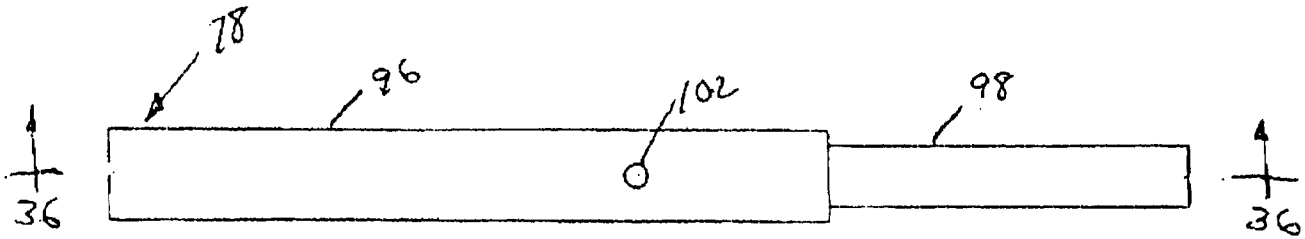
FIGS. 35 to 38 are various views of a first alternative embodiment of the central brace member of the receptacle.
Figure 36:
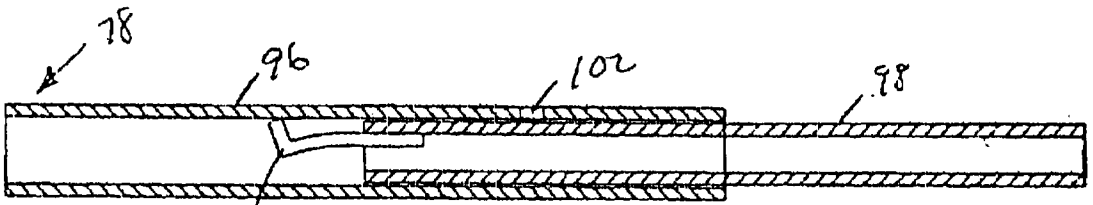
Figure 37:
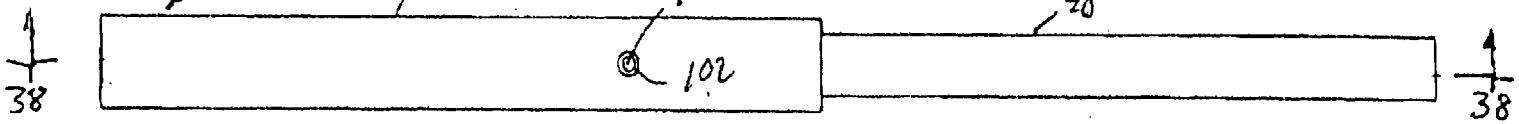
Figure 38:
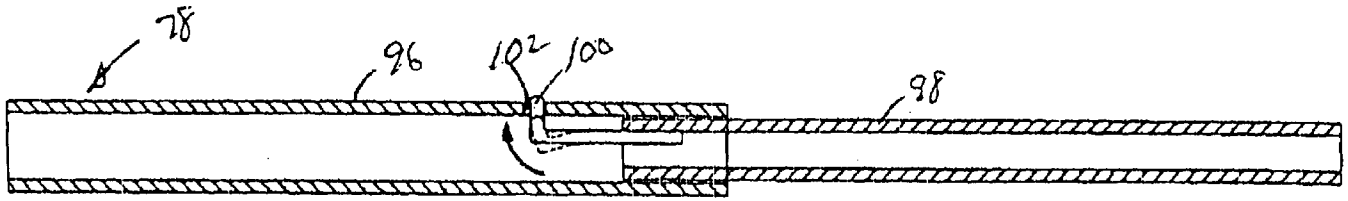
Figure 39:
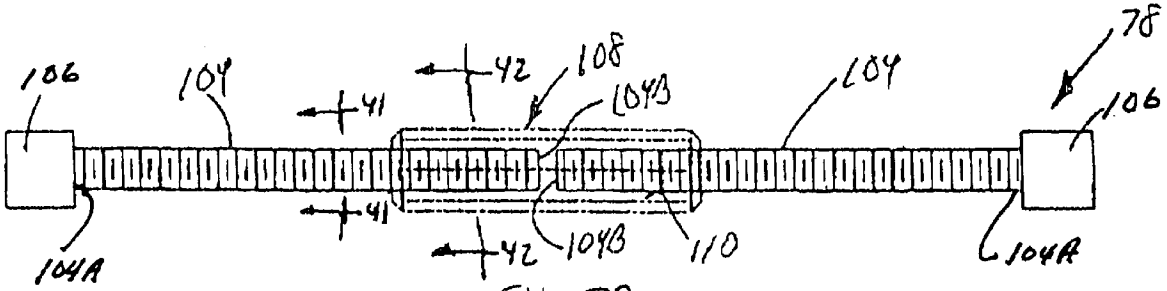
FIGS. 39 to 42 are various views of a second alternative embodiment of the central brace member of the receptacle.
Figure 40:
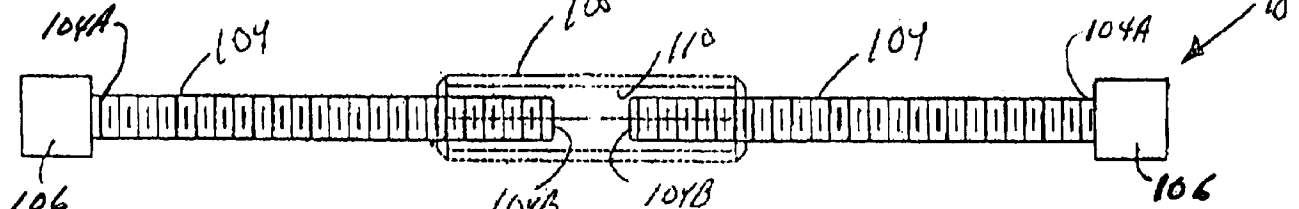
Figure 42:
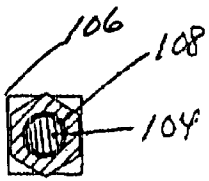
Figure 41:
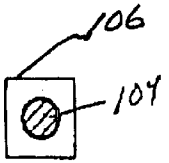

In FIGS. 20 to 26, there is shown the second alternative embodiment of the receptacle 12 which includes elastic longitudinal rods 18 having opposite ends 18A of T-shaped configurations which fit through with holes 85 defined in the peripheral portions 22 of the opposite end support members 16 of the receptacle 12. The holes 85 having outer cylindrical-shaped counter bore portions 85A of larger size than rectangular-shaped inner portions 85B thereof so as to form shoulders 85C against which the T-shaped ends 18A are captured once the ends 18A have been inserted through the inner portions 85B, as seen in FIG. 25, and then rotated so as to seat on the shoulders 85C, as seen in FIG. 26.

In FIGS. 27 to 34, there is shown the third alternative embodiment of the receptacle 12 which includes a pair of opposite end support members 16, as seen in FIGS. 27 to 30, and an elastic cage 86 having a pair of elastic ring end members 88 and a plurality of longitudinal elastic elements or rods 90 extending between and interconnecting the ring end members 88. With the opposite end support members 16 being spaced apart at a fixed distance by the central brace member 78, the elastic cage 86 is stretched over the opposite end support members 16 and seated in circumferentially spaced slots 92 defined about the peripheral portions 22 of the opposite end support members 16 and circular grooves 94 defined in the outer sides of the peripheral portions 22 of the opposite end support members 16. The length of the elastic cage 86 is preselected so that a predetermined amount of elastic stretch will be placed on the longitudinal elastic rods 90 when the central brace member 78 is inserted between the opposite end support members 16 so that balls will be permitted to enter between the rods 90 and still be prevented from dropping out the receptacle 12. The central brace member 78 and its mounting relationship to the opposite end support members 16 ensures that the support members 16 rotate in unison so as to maintain the longitudinal rods 90 in their desired spaced apart relationship.

Referring now to FIGS. 35 to 42, there is shown first and second alternative embodiments of the central brace member 78 of the receptacle 12. In FIGS. 35 to 38, there is shown the first embodiment of the central brace member 78 which includes telescoping outer and inner tubular elements 96, 98 with an internal spring locking clip 100 attached to the inner tubular element 98 and extendable into an engagement hole 102 in the outer tubular element 96. In FIGS. 39 to 42, there is shown the second embodiment of the central brace member 78 which includes right side and left side threaded rod elements 104, recess-engaging end elements 106 threaded on outer ends 104A of the threaded rod elements 104 and a central adjustment nut element 108 having a threaded central bore 110 receiving and threadably engaging inner ends 104B of the threaded rod elements 104. Turning the central adjustment nut element 108 in one direction moves the threaded rod elements 104 away from one another, increasing the length of the brace member 78, whereas turning the central adjustment nut element 108 in an opposite direction draws the threaded rod elements 104 toward one another, decreasing the length of the brace member 78.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A sports ball retrieval and dispensing device, comprising:

(a) a ball retrieving and dispensing receptacle constructed of a plurality of separate parts being convertible between an assembled condition in which said receptacle parts are mounted to one another so as to enable use of said device in carrying out ball retrieving and dispensing modes of operation and a disassembled condition in which at least some of said receptacle parts are taken apart from one another such that said device occupies a smaller volume of space with said receptacle in said disassembled condition than in said assembled condition so as to enable shipping of said device, said separate parts of said receptacle including (i) a pair of opposite end support members having respective peripheral portions, (ii) a plurality of longitudinal elements extending between and coupled at opposite ends to said opposite end support members so as to form an enclosure structure therewith defining a holding chamber for receiving and collecting a multiplicity of sports balls, said longitudinal elements being spaced apart from one another about said peripheral portions of said opposite end support members through distances less than a diameter of one of the sports ball to permit insertion of the sport balls between adjacent ones of said longitudinal elements for entry into said holding chamber, and (iii) a gate structure pivotally mounted to and extending between said opposite end support members, said gate structure including a pair of arcuate-shaped end elements each mounted to said peripheral portion of one of said opposite end support members for undergoing pivotal movement between opened and closed positions relative to said opposite end support members and at least one of said longitudinal elements extending between and attached at said opposite ends thereof to said arcuate-shaped end elements; and (b) a handle coupled to said receptacle in said assembled condition so as to support said receptacle and thereby enable use of said device in carrying out said ball retrieving and dispensing modes of operation.

2. The device as recited in claim 1, wherein said longitudinal elements are elongated rods made of fiber reinforced plastic.

3. The device as recited in claim 1, wherein said longitudinal elements are elongated rods made of fiber reinforced epoxy.

4. The device as recited in claim 1, wherein said longitudinal elements are stretchable elastic bands.

5. The device as recited in claim 1, wherein said longitudinal elements are captured at said opposite ends thereof in recesses defined in inner sides of said peripheral portions of said opposite end support members that face toward one another.

6. The device as recited in claim 1, wherein said longitudinal elements are fastened at said opposite ends thereof to said opposite end support members.

7. A sports ball retrieval and dispensing device, comprising:

(a) a ball retrieving and dispensing receptacle constructed of a plurality of separate parts being convertible between an assembled condition in which said receptacle parts are mounted to one another so as to enable use of said device in carrying out ball retrieving and dispensing modes of operation and a disassembled condition in which at least some of said receptacle parts are taken apart from one another such that said device occupies a smaller volume of space with said receptacle in said disassembled condition than in said assembled condition so as to enable shipping of said device, said separate parts of said receptacle including (i) a pair of opposite end support members having respective peripheral portions, and (ii) a plurality of longitudinal elements extending between and coupled at opposite ends to said opposite end support members so as to form an enclosure structure therewith defining a holding chamber for receiving and collecting a multiplicity of sports balls, said longitudinal elements being spaced apart from one another about said peripheral portions of said opposite end support members through distances less than a diameter of one of the sports ball to permit insertion of the sport balls between adjacent ones of said longitudinal elements for entry into said holding chamber; and (b) a handle coupled to said receptacle in said assembled condition so as to support said receptacle and thereby enable use of said device in carrying out said ball retrieving and dispensing modes of operation, said handle including an inner yoke member rotatably mounting said opposite end support members of said receptacle to said handle; and an outer handle member detachably coupled to said inner yoke member.

8. The device as recited in claim 7, wherein said inner yoke member of said handle includes:

a top portion having opposite ends spaced apart at a distance greater than a distance between said opposite end support members of said receptacle, said top portion extending in a generally parallel relationship to said longitudinal elements of said receptacle and in a generally transverse relationship to said opposite end support members of said receptacle; and a pair of opposite side portions fixedly attached to said opposite ends of said top portion and extending therefrom toward said receptacle, said opposite side portions also extending in a generally transverse relationship to said top portion and to said longitudinal elements of said receptacle and in a generally parallel relationship to said opposite end support members and along outer sides of said opposite end support members that face in opposite directions away from one another, said opposite side portions having respective ends disposed adjacent and rotatably coupled to respective central hubs defined on said opposite end supports of said receptacle.

9. The device as recited in claim 7, wherein said handle further includes a pair of latches insertable through and removable from aligned apertures defined in adjacent portions of said inner yoke member and outer handle member for connecting said outer handle member to and disconnecting said outer handle member from said inner yoke member.

10. A sports ball retrieval and dispensing device, comprising:

(a) a ball retrieving and dispensing receptacle having a pair of opposite end support members and a plurality of longitudinal elements extending between said opposite ends support members and being constructed as to enable use of said device in carrying out ball retrieving and dispensing modes of operation; and (b) a handle constructed of separate parts being convertible between an assembled condition in which said handle parts are mounted to one another and coupled to said receptacle so as to support said receptacle and thereby enable use of said device in carrying out said ball retrieving and dispensing modes of operation and a disassembled condition in which at least some of said handle parts are taken apart from one another such that said device occupies a smaller volume of space with said handle in said disassembled condition than in said assembled condition so as to enable shipping of said device, said separate parts of said handle including (i) an inner yoke member pivotally mounting said receptacle at said opposite ends thereof to said handle, said inner yoke member of said handle including a top portion having opposite ends spaced apart at a distance greater than a distance between said opposite end support members of said receptacle, said top portion extending in a generally parallel relationship to said longitudinal elements of said receptacle and in a generally transverse relationship to said opposite end support members of said receptacle; and a pair of opposite side portions fixedly attached to opposite ends of said top portion and extending therefrom toward said receptacle, said opposite side portions also extending in a generally transverse relationship to said top portion and to said longitudinal elements of said receptacle and in a generally parallel relationship to said opposite end support members and along outer sides of said opposite end support members that face in opposite directions away from one another, said opposite side portions having respective ends disposed adjacent and rotatably coupled to respective central hubs defined on said opposite end support members of said receptacle; and (ii) an outer handle member detachably connected to said inner yoke member.

11. The device as recited in claim 10, wherein said handle further includes a pair of latches insertable through and removable from aligned apertures defined in adjacent portions of said inner yoke member and outer handle member for connecting said outer handle member to and disconnecting said outer handle member from said inner yoke member and thereby converting said handle between said assembled and disassembled conditions.

12. The device as recited in claim 10, wherein said handle further includes a pair of pins insertable through and removable from aligned apertures defined in said opposite side portions of said inner yoke member and said opposite end support members of said receptacle for locking said receptacle against undergoing rotation relative to said handle when said device is in said ball dispensing mode of operation.

13. A sports ball retrieval and dispensing device, comprising:

(a) a ball retrieving and dispensing receptacle having a pair of opposite end support members and a plurality of longitudinal elements extending between said opposite ends support members and being constructed as to enable use of said device in carrying out ball retrieving and dispensing modes of operation, said pair of opposite end support members having respective peripheral portions and said plurality of longitudinal elements being coupled at opposite ends to said opposite end support members so as to form an enclosure structure therewith defining a holding chamber for receiving and collecting a multiplicity of sports balls, said longitudinal elements being spaced apart from one another about said peripheral portions of said opposite end supports through distances less than a diameter of one of the sports ball to permit insertion of the sport balls between adjacent ones of said longitudinal elements for entry into said holding chamber; and (b) a handle constructed of separate parts being convertible between an assembled condition in which said handle parts are mounted to one another and coupled to said receptacle so as to support said receptacle and thereby enable use of said device in carrying out said ball retrieving and dispensing modes of operation and a disassembled condition in which at least some of said handle parts are taken apart from one another such that said device occupies a smaller volume of space with said handle in said disassembled condition than in said assembled condition so as to enable shipping of said device, said longitudinal elements being captured at said opposite ends thereof in recesses defined in inner sides of said peripheral portions of said opposite end support members that face toward one another.

14. The device as recited in claim 13, wherein said longitudinal elements are elongated rods made of fiber reinforced plastic.

15. The device as recited in claim 13, wherein said longitudinal elements are elongated rods made of fiber reinforced epoxy.

16. The device as recited in claim 13, wherein said longitudinal elements are stretchable elastic bands.

17. The device as recited in claim 13, wherein said receptacle further includes a gate structure pivotally mounted to and extending between said opposite end support members.

18. The device as recited in claim 17, wherein said gate structure includes:

a pair of arcuate-shaped end elements each mounted to said peripheral portion of one of said opposite end support members for undergoing pivotal movement between opened and closed positions relative to said opposite end support members; and at least one of said longitudinal elements extending between and attached at said opposite ends thereof to said arcuate-shaped end elements.

19. A sports ball retrieval and dispensing device, comprising:

(a) a ball retrieving and dispensing receptacle constructed of a plurality of separate parts being convertible between an assembled condition in which said receptacle parts are mounted to one another so as to enable use of said device in carrying out ball retrieving and dispensing modes of operation and a disassembled condition in which at least some of said receptacle parts are taken apart from one another such that said device occupies a smaller volume of space with said receptacle in said disassembled condition than in said assembled condition so as to enable shipping of said device, said separate parts of said receptacle including (i) a pair of opposite end support members having respective peripheral portions, and (ii) a plurality of longitudinal elements extending between and coupled at opposite ends to said opposite end support members so as to form an enclosure structure therewith defining a holding chamber for receiving and collecting a multiplicity of sports balls, said longitudinal elements being spaced apart from one another about said peripheral portions of said opposite end supports through distances less than a diameter of one of the sports ball to permit insertion of the sport balls between adjacent ones of said longitudinal elements for entry into said holding chamber; and (b) a handle constructed of a plurality of separate parts being convertible between an assembled condition in which said handle parts are mounted to one another and coupled to said receptacle in said assembled condition so as to support said receptacle and thereby enable use of said device in carrying out said ball retrieving and dispensing modes of operation and a disassembled condition in which at least some of said handle parts are taken apart from one another such that said device occupies a smaller volume of space with said handle in said disassembled condition than in said assembled condition so as to enable shipping of said device.

20. The device as recited in claim 19, wherein said longitudinal elements are elongated rods made of fiber reinforced plastic.

21. The device as recited in claim 19, wherein said longitudinal elements are elongated rods made of fiber reinforced epoxy.

22. The device as recited in claim 19, wherein said longitudinal elements are stretchable elastic bands.

23. The device as recited in claim 19, wherein said longitudinal elements are captured at said opposite ends thereof in recesses defined in inner sides of said peripheral portions of said opposite end support members that face toward one another.

24. The device as recited in claim 19, wherein said longitudinal elements are fastened at said opposite ends thereof to said opposite end support members.

25. The device as recited in claim 19, wherein said separate parts of said receptacle further include a gate structure pivotally mounted to and extending between said opposite end support members.

26. The device as recited in claim 25, wherein said gate structure includes:

a pair of arcuate-shaped end elements each mounted to said peripheral portion of one of said opposite end support members for undergoing pivotal movement between opened and closed positions relative to said opposite end support members; and at least one of said longitudinal elements extending between and attached at said opposite ends thereof to said arcuate-shaped end elements.

27. The device as recited in claim 19, wherein said handle includes:

an inner yoke member rotatably mounting said opposite end support members of said receptacle to said handle; and an outer handle member detachably coupled to said inner yoke member.

28. The device as recited in claim 27, wherein said separate parts of said handle further include a pair of latches insertable through and removable from aligned apertures defined in adjacent portions of said inner yoke member and outer handle member for connecting said outer handle member to and disconnecting said outer handle member from said inner yoke member and thereby converting said handle between said assembled and disassembled conditions.

29. The device as recited in claim 27, wherein said inner yoke member of said handle includes:

a top portion having opposite ends spaced apart at a distance greater than a distance between said opposite end support members of said receptacle, said top portion extending in a generally parallel relationship to said longitudinal elements of said receptacle and in a generally transverse relationship to said opposite end support members of said receptacle; and a pair of opposite side portions fixedly attached to opposite ends of said top portion and extending therefrom toward said receptacle, said opposite side portions also extending in a generally transverse relationship to said top portion and to said longitudinal elements of said receptacle and in a generally parallel relationship to said opposite end support members and along outer sides of said opposite end support members that face in opposite directions away from one another, said opposite side portions having respective ends disposed adjacent and rotatably coupled to respective central hubs defined on said opposite end supports of said receptacle.

30. The device as recited in claim 29, wherein said handle further includes a pair of pins insertable through and removable from aligned apertures defined in said opposite side portions of said inner yoke member and said opposite end support members of said receptacle for locking said receptacle against undergoing rotation relative to said handle when said device is in said ball dispensing mode of operation.

31. A sports ball retrieval and dispensing device, comprising:

(a) a ball retrieving and dispensing receptacle constructed of a plurality of separate parts being convertible between an assembled condition in which said receptacle parts are mounted to one another so as to enable use of said device in carrying out ball retrieving and dispensing modes of operation and a disassembled condition in which at least some of said receptacle parts are taken apart from one another such that said device occupies a smaller volume of space with said receptacle in said disassembled condition than in said assembled condition so as to enable shipping of said device; and (b) a handle constructed of a plurality of separate parts being convertible between an assembled condition in which said handle parts are mounted to one another and coupled to said receptacle in said assembled condition so as to support said receptacle and thereby enable use of said device in carrying out said ball retrieving and dispensing modes of operation and a disassembled condition in which at least some of said handle parts are taken apart from one another such that said device occupies a smaller volume of space with said handle in said disassembled condition than in said assembled condition so as to enable shipping of said device, said separate parts of said receptacle including a gate structure pivotally movable between opened and closed positions.

32. A sports ball retrieval and dispensing device, comprising:

(a) a ball retrieving and dispensing receptacle having a pair of opposite ends and being constructed as to enable use of said device in carrying out ball retrieving and dispensing modes of operation;

(b) a handle coupled to said receptacle so as to rotatably support said receptacle on said handle and thereby enable use of said device in carrying out said ball retrieving and dispensing modes of operation, said handle including (i) an inner yoke member having opposite ends between which said receptacle is disposed and at said opposite ends of said receptacle is rotatably mounted to said opposite ends of said inner yoke member, and (ii) an outer handle member attached to said inner yoke member and having a structural configuration permitting placement of said device in a first orientation wherein said outer handle member positions said receptacle therebelow in movable contact with a surface so that a user can grasp said outer handle member and move said receptacle across the surface in said ball retrieving mode of operation and a second orientation wherein said outer handle member stands stationarily on a surface so as to position said receptacle thereabove so that a user can withdraw balls from said receptacle in said ball dispensing mode of operation; and (c) at least one pin insertable through and removable from aligned apertures defined in said inner yoke member and said receptacle for locking said receptacle against undergoing rotation relative to said handle when said outer handle member is in said second orientation and said device is in said ball dispensing mode of operation.

33. The device as recited in claim 32, wherein said handle further include a pair of latches insertable through and removable from aligned apertures defined in adjacent portions of said inner yoke member and outer handle member for connecting said outer handle member to said inner yoke member in an assembled condition and disconnecting said outer handle member from said inner yoke member in an disassembled condition and thereby converting said handle between said assembled and disassembled conditions.

34. The device as recited in claim 32, wherein said inner yoke member of said handle includes a pair of opposite side portions disposed adjacent to and outwardly of said opposite ends of said receptacle, a pair of said pins being insertable through and removable from aligned apertures defined in said opposite side portions of said inner yoke member and said opposite ends of said receptacle for locking said receptacle against undergoing rotation relative to said handle when said outer handle member is in said second orientation and said device is in said ball dispensing mode of operation.

35. A sports ball retrieval and dispensing device, comprising:

(a) a ball retrieving and dispensing receptacle being constructed as to enable use of said device in carrying out ball retrieving and dispensing modes of operation, said receptacle including (i) a pair of opposite end support members having respective peripheral portions, and (ii) a plurality of longitudinal elements having respective opposite ends and extending between and coupled to said opposite end support members at said peripheral portions thereof, and (iii) means for holding said longitudinal elements together with said opposite end support members of said receptacle so as to form an enclosure structure defining a holding chamber for receiving and collecting a multiplicity of sports balls, said means for holding including a brace structure having opposite ends and extending between and being fitted at said opposite ends into recesses formed in central portions of said opposite end support members of said receptacle, said longitudinal elements being spaced apart from one another about said peripheral portions of said opposite end support members through distances less than a diameter of one of the sport balls to permit insertion of the sport balls between adjacent ones of said longitudinal elements for entry into said holding chamber; and (b) a handle coupled to said receptacle so as to rotatably support said receptacle on said handle and thereby enable use of said device in carrying out said ball retrieving and dispensing modes of operation, said handle including (i) an inner yoke member having opposite ends between which said receptacle is disposed, said receptacle having respective central portions defined on said opposite end support members of said receptacle which are aligned with and rotatably mounted to said opposite ends of said inner yoke member, and (ii) an outer handle member coupled to said inner yoke member for grasping by a user.

36. The device as recited in claim 35, wherein said longitudinal elements are stretchable elastic bands.

37. The device as recited in claim 35, wherein said longitudinal elements are in the form of an elastic cage having a pair of elastic ring end members and a plurality of longitudinal elastic elements extending between and interconnecting said ring end members, said elastic cage being stretched over said opposite end support members.

38. The device as recited in claim 35, wherein said means for holding said longitudinal elements together with said opposite end support members of said receptacle so as to form said enclosure structure further includes a plurality of holes defined through said peripheral portions of said opposite end support members of said receptacle and a plurality of fasteners attached on said opposite ends of said longitudinal elements which extend through and beyond said holes through said peripheral portions of said opposite end support members of said receptacle.

39. The device as recited in claim 35, wherein said receptacle further includes a gate structure pivotally mounted to and extending between said opposite end support members.

40. The device as recited in claim 39, wherein said gate structure includes:

a pair of arcuate-shaped end elements each mounted to said peripheral portion of one of said opposite end support members for undergoing pivotal movement between opened and closed positions relative to said opposite end support members; and at least one of said longitudinal elements extending between and attached at said opposite ends thereof to said arcuate-shaped end elements.

41. A sports ball retrieval and dispensing device, comprising:

(a) a ball retrieving and dispensing receptacle being constructed as to enable use of said device in carrying out ball retrieving and dispensing modes of operation, said receptacle including (i) a pair of opposite end support members having respective peripheral portions, and (ii) a plurality of longitudinal elements having respective opposite ends and extending between and coupled to said opposite end support members at said peripheral portions thereof, and (iii) means for holding said longitudinal elements together with said opposite end support members of said receptacle so as to form an enclosure structure defining a holding chamber for receiving and collecting a multiplicity of sports balls, said means for holding including recesses defined in inner sides of peripheral portions of said opposite end support members that face toward one another with said opposite ends of said longitudinal elements captured within said recesses, said longitudinal elements being spaced apart from one another about said peripheral portions of said opposite end support members through distances less than a diameter of one of the sport balls to permit insertion of the sport balls between adjacent ones of said longitudinal elements for entry into said holding chamber; and (b) a handle coupled to said receptacle so as to rotatably support said receptacle on said handle and thereby enable use of said device in carrying out said ball retrieving and dispensing modes of operation, said handle including (i) an inner yoke member having opposite ends between which said receptacle is disposed, said receptacle having respective central portions defined on said opposite end support members of said receptacle which are aligned with and rotatably mounted to said opposite ends of said inner yoke member, and (ii) an outer handle member coupled to said inner yoke member for grasping by a user.

42. The device as recited in claim 41, wherein said longitudinal elements are elongated rods made of fiber reinforced plastic.

43. The device as recited in claim 41, wherein said longitudinal elements are elongated rods made of fiber reinforced epoxy.

44. A sports ball retrieval and dispensing device, comprising:

(a) a ball retrieving and dispensing receptacle constructed of a plurality of separate parts being convertible between an assembled condition in which said receptacle parts are mounted to one another so as to enable use of said device in carrying out ball retrieving and dispensing modes of operation and a disassembled condition in which at least some of said receptacle parts are taken apart from one another such that said device occupies a smaller volume of space with said receptacle in said disassembled condition than in said assembled condition so as to enable shipping of said device;

(b) a handle coupled to said receptacle in said assembled condition so as to support said receptacle and thereby enable use of said device in carrying out said ball retrieving and dispensing modes of operation; and (c) means for preventing rotation of said receptacle relative to said handle during said dispensing mode of operation of said device.

45. The device as recited in claim 44, wherein said separate parts of said receptacle include a gate structure pivotally movable between opened and closed positions.

* * * * *